US007317663B2

(12) United States Patent
Kawashima et al.

(10) Patent No.: US 7,317,663 B2
(45) Date of Patent: Jan. 8, 2008

(54) ULTRASONIC SENSOR

(75) Inventors: Yasuhiro Kawashima, Okazaki (JP); Hiroyuki Kani, Okazaki (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/727,454

(22) Filed: Mar. 27, 2007

(65) Prior Publication Data

US 2007/0237031 A1 Oct. 11, 2007

(30) Foreign Application Priority Data

Apr. 10, 2006 (JP) ..... 2006-107291

(51) Int. Cl.
*H04R 17/00* (2006.01)

(52) U.S. Cl. ..... 367/188

(58) Field of Classification Search ..... 367/140, 367/178, 180, 188, 909; 310/345; 600/459; 73/649

See application file for complete search history.

(56) References Cited

U.S. PATENT DOCUMENTS

| | | | | |
|---|---|---|---|---|
| 3,964,296 | A * | 6/1976 | Matzuk | 73/607 |
| 2006/0241474 | A1* | 10/2006 | Kawashima et al. | 600/459 |

FOREIGN PATENT DOCUMENTS

| | | | |
|---|---|---|---|
| EP | 0 881 624 | B1 | 4/2003 |
| JP | 5-62884 | | 8/1993 |
| JP | 8-005615 | | 1/1996 |
| JP | 8-130795 | | 5/1996 |
| JP | 11-187491 | | 7/1999 |
| JP | 2000-023288 | | 1/2000 |
| JP | 2002055156 | A * | 2/2002 |
| JP | 2002-199481 | | 7/2002 |
| JP | 2006279567 | A * | 10/2006 |

* cited by examiner

*Primary Examiner*—Daniel Pihulic
(74) *Attorney, Agent, or Firm*—Nixon & Vanderhye P.C.

(57) ABSTRACT

An ultrasonic sensor has an intermediate connection member for having electrical connection between an ultrasonic transducer and a circuit board. A connection pin of the transducer supported by the intermediate connection member is prevented from being damaged when an excessive pressing force on the transducer pushes the transducer into a case, because a deformation of the connection member releases the force without damaging the connection between the transducer and the circuit board.

7 Claims, 3 Drawing Sheets

ULTRASONIC SENSOR

CROSS REFERENCE TO RELATED APPLICATION

This application is based on and claims the benefit of priority of Japanese Patent Application No. 2006-107291 filed on Apr. 10, 2006, the disclosure of which is incorporated herein by reference.

FIELD OF THE INVENTION

The present invention generally relates to an ultrasonic sensor for use in a vehicle.

BACKGROUND INFORMATION

In recent years, an ultrasonic sensor is widely used for detecting objects, and the ultrasonic sensor having an ultrasonic transducer is proposed in, for example, Japanese patent document No. JP-A-2004-159351. The sensor disclosed in the above reference includes an ultrasonic transducer having a piezoelectric element pasted on a bottom of a cylindrical housing of the transducer and a case for housing the transducer that is inserted from an opening formed thereof. The piezoelectric element is electrically coupled with a circuit board in the case by a lead.

The lead for coupling the piezoelectric element with the circuit board is replaced with a connection pin, mainly due to an increasing demand for improvement of workability. Therefore, an alternative structure for electrically coupling the piezoelectric element with the circuit board by using a connection pin with an insulating base disposed on the bottom of the housing with the connection pin piercing therethrough is proposed, for example, in Japanese patent documents No. JP-A-H08-130795, and No. JP-A-H11-87491.

The ultrasonic transducer is conventionally disposed on a case with a vibration absorbing material pasted thereon for preventing the vibration to be transmitted to the case when the ultrasonic wave is generated by the transducer. That is, an outer surface of the transducer and a bottom of it are covered by the vibration absorbing material for preventing the vibration to be transmitted to an opening of the case.

However, the elasticity of the absorbing material may lead to a deformation of the absorbing material, and thereby causing a break of the connection pin due to, for example, a dislocation of the transducer in an insertion direction into the case by a pressing force from outside. That is, the electrical coupling between the connection pin and the circuit board is broken due to the pressing force for warping the connection pin in the insertion direction for causing a reaction force at a soldered portion of the connection pin.

Particularly, when an additional foaming member is disposed under the base of the housing, the pressing force on the transducer causes a larger dislocation of the transducer, and the problem described above may become more distinctive.

SUMMARY OF THE INVENTION

In view of the above and other problems, the present invention provides an ultrasonic sensor that prevents unintended breakage of electrical connection between a piezoelectric element and a circuit board when an ultrasonic transducer in the sensor is pushed into a case.

The ultrasonic sensor of the present disclosure includes an ultrasonic transducer in a housing with a bottom and a cylindrical body, a cylindrical elastic member that covers an outer peripheral surface and a connection pin pull-out surface of the transducer, a hollow case having an opening through which the transducer is inserted therein, a joining pin disposed in an exposing manner in a hollow space in the case, and a circuit board disposed in the hollow space of the case in an electrically coupled condition with the piezoelectric element. In the above structure, the bottom of the housing has a piezoelectric element disposed on an inside surface, and the piezoelectric element has a connection pin electrically coupled with the element with one end extending out of the housing. Further, the connection pin pierces a base that is disposed on the housing. In addition, the case holds the transducer with the elastic member disposed thereon in the opening.

Further, an exposed portion of the joining pin is electrically coupled with the connection pin in the hollow space in the case, and the joining pin warps in an insertion direction when the connection pin is pressed in the insertion direction of the transducer into the opening.

Furthermore, the electrically coupled condition of the circuit board with the piezoelectric element is achieved by an electrical coupling of the circuit board with the joining pin and the connection pin.

In the above structure, the connection pin coupled with the circuit board indirectly through the joining pin allows an external force for pushing the transducer into the case to be released in deformation of the joining pin. In this manner, the electrical connection between the piezoelectric element and the circuit board is prevented from being damaged.

BRIEF DESCRIPTION OF THE DRAWINGS

Other objects, features and advantages of the present invention will become more apparent from the following detailed description made with reference to the accompanying drawings, in which.

DETAILED DESCRIPTION

Preferred embodiments of the present invention will now be described with reference to the accompanying the drawings. Like parts have like numbers in the embodiments

FIRST EMBODIMENT

The ultrasonic sensor in a first embodiment is described in the following. The ultrasonic sensor in the present embodiment is used, for example, as a back sonar or a corner sonar when it is disposed on a bumper of a vehicle.

Figure 1A:
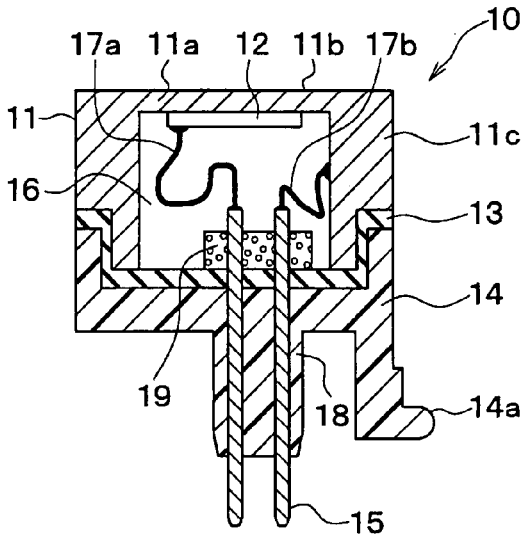
FIG. 1A shows a cross-sectional view of an ultrasonic transducer in an embodiment of the present disclosure.
Figure 1C:
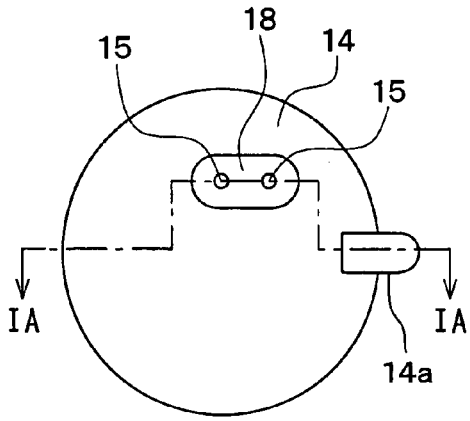
FIG. 1C shows a bottom view of an ultrasonic transducer in the embodiment.
Figure 1B:
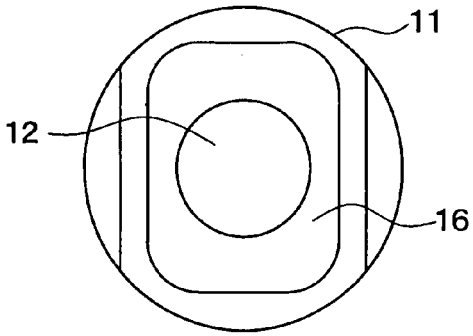
FIG. 1B shows a bottom view of a housing of the ultrasonic transducer having a piezoelectric element in the embodiment.
Figure 1D:
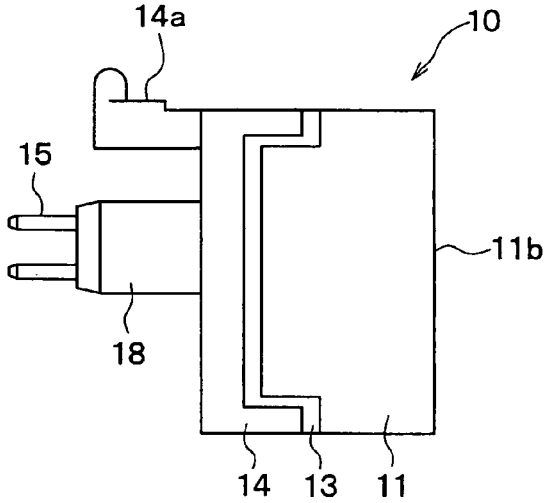
FIG. 1D shows a side view of an ultrasonic transducer in the embodiment.

FIGS. 1A to 1D show illustrations of an ultrasonic transducer 10 in an ultrasonic sensor 100 in a first embodiment of the present disclosure. That is, FIG. 1A is a cross-sectional view, FIG. 1B is a bottom view of a housing 11, FIG. 1C is a bottom view, and FIG. 1D is a side view of the transducer 10. The cross-sectional view in FIG. 1A is taken along IA-IA line in FIG. 1C. FIG. 1B shows an illustration that the housing 11 has a piezoelectric element 12 disposed therein.

The ultrasonic transducer 10 includes the housing 11 having a bottom in a cylindrical shape, the piezoelectric element 12, the base 14 disposed in an opening of the housing 11 with a spacer 13, and a connection pin 15 in an electrical connection with the piezoelectric element 12 on one end. The other end of the connection pin 15 pierces the base 14 to be extended toward an outside of the housing 11.

The housing 11 is made of a conductive material (a metal or an insulation material with a metallic coat formed thereon). The housing 11 has an inner space 16 formed therein. A bottom 11*a* of the housing 11 has the piezoelectric element 12 being pasted on an inner surface. An outer surface of the bottom 11*a* is a vibration surface 11*b*. In the present embodiment, the conductive material is an aluminum, and the vibration surface 11*b* is in a round shape. An upper side of the inner space 16 has a rectangular shape having respectively different length and width (corners of the rectangular shape are rounded) as shown in FIG. 1B. The shape of the inner space 16 defines directivity of the transducer 10, that is, respectively different directivities in a horizontal and a vertical direction. In this case, the directivity of the transducer 10 is wide in the horizontal direction and narrow in the vertical direction.

The piezoelectric element 12 includes a piezo-ceramic element (e.g., lead zirconate titanate) having electrodes on both surfaces on a front and a back side (not shown in the figure), and one of the electrode on the surface is attached to the bottom 11*a* of the housing 11 by using, for example, a conductive adhesive. One of the electrodes is in electrical coupling with one of a pair of the connection pins 15 by using a lead 17*a*, and the other electrode is pasted on the bottom of the housing 11 with the conductive adhesive to be coupled with the other one of the pair of the connection pins 15 after being coupled with a lead 17*b* through the housing 11 that is made of conductive material. The inner space 16 of the housing 11 is filled with a felt and a silicon in order from the piezoelectric element 12 side poured from a hole (not shown in the figure) disposed on the spacer 13 and the base 14 for controlling an unnecessary vibration transferred from the vibration surface to the connection pins 15.

The spacer 13 disposed between an opening of the housing 11 and the base 14 is an elastic body for controlling transfer of the unnecessary vibration on a cylinder 11*c* of the housing 11 caused by the vibration of the bottom 11*a* of the housing 11 to the base that holds the connection pins 15. The spacer 13 is made of, for example, a silicone rubber. The spacer 13 used in the present embodiment may be omitted.

The base 14 is made of an insulation material for having the connection pins 15 piercingly disposed therethrough, and is disposed around an outer surface on an opening side of the housing 11 with the spacer 13 interposed therebetween. The insulation material of the present disclosure is, for example, a synthetic material such as an ABS resin. Portions of the connection pins 15 are laid in the base 14 by using insert molding. In the base 14, a protector portion 18 extends along a longitudinal direction of the connection pins 15 for protecting the pins 15. The protector portion 18 protects a predetermined portion of the connection pins 15 extending toward an outside of the housing 11. A single body of the protector portion 18 covers a pair of the connection pins 15.

Further, in the base 14, a first marker 14*a* is formed in a protruding manner in a protruding direction of the connection pins 15. A tip end of the first marker 14*a*, as shown in FIGS. 1C and 1D, partially protrudes from the outer surface of the base 14 in a radially outward direction.

The connection pins 15 are, for example, mainly made of cupper, and has a thickness of 0.5 mm in diameter. In the present embodiment, the protector portion 18 and the connection pins 15 are positioned away from a center of the transducer 10 (i.e., the housing 11) because configuration of the respectively different directivities of the transducer 10 in the horizontal and vertical directions.

The protector portion 18 may be separately formed from the base 14, and may be attached on the base 14 by, for example, using an adhesive. Further, each of the pins 15 may be separately covered and protected. The pins 15 may be attached to a predetermined position of the base 14 and the protector portion 18 by using an adhesive instead of using insert molding.

The ultrasonic transducer 10 includes a foamed elastic body 19 on the base 14 as a damper. The foamed elastic body 19 of the present disclosure is, for example, a foamed silicon. The connection pin 15 pierces the foamed elastic body 19. The foamed elastic body 19 may be omitted. The housing 11, the spacer 13, the base 14, and the foamed silicon 19 are attached to each other by using an adhesive (e.g., a silicon type adhesive) to form the transducer 10.

Figure 2A:
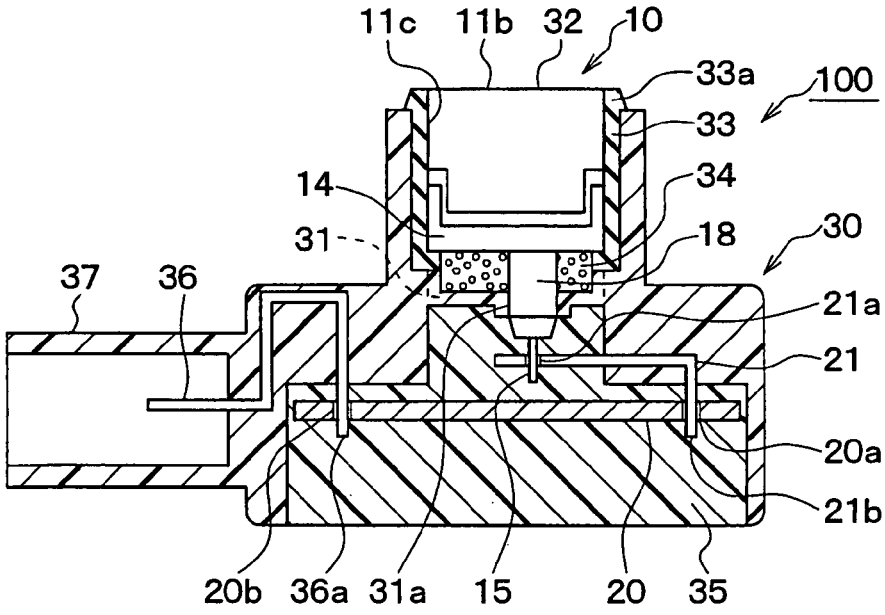
FIG. 2A shows a cross-sectional view of an ultrasonic sensor in the embodiment.
Figure 2B:
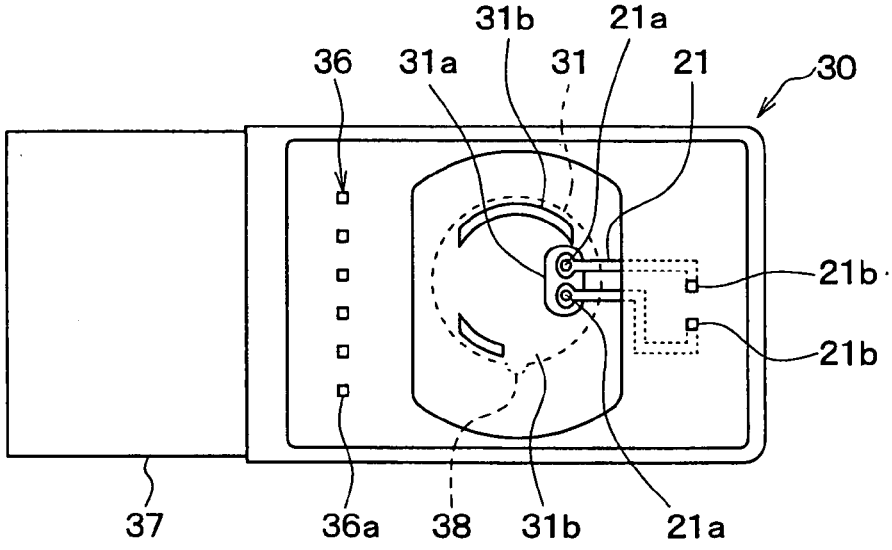
FIG. 2B shows a bottom view of a case of the ultrasonic sensor in the embodiment.

FIGS. 2A and 2B show illustrations of the ultrasonic sensor 100 in FIG. 1A in the present embodiment. That is, FIG. 2A shows a cross-sectional view, and FIG. 2B shows a bottom view of a case 30 for housing a circuit board 20 of the sensor 100 taken from a reverse side of the case 30. In FIG. 2A, electrical components on the circuit board 20 are omitted for illustration purposes.

The ultrasonic sensor 100 includes the ultrasonic transducer 10 and the circuit board 20 for applying voltage on the transducer 10 to generate the ultrasonic wave and for processing voltage induced by a reverse effect of the transducer 10. The transducer 10 and the circuit board 20 are disposed in the case 30 that is made of synthetic resin.

The case 30 has a guide portion 31 for positioning the pins 15 and the protector portion 18 relative to a connection portion of the circuit board 20. the guide portion 31 is formed as a portion of the case 30.

The guide portion 31 is formed as a separator for separating the space in the case 30 to a space for the transducer 10 and a space for the circuit board 20. The guide portion 31 has a positioning hole 31*a* for having the protector portion 18 inserted therein. The hole 31*a* has a same shape as an outer shape of the protector portion 18 (e.g., an oval shape in the present embodiment), and has the same size or a slightly larger size than the protector portion 18. By inserting protector portion 18 together with the connection pins 15 into the positioning hole 31*a* in the guide portion 31, the transducer 10 is positioned relative to the case 30, as well as the connection pins 15 of the transducer 10 relative to the circuit board 20.

Further, the guide portion 31 has another hole separately from the positioning hole 31*a*. The another hole is designated as a piercing hole 31*b*, and the hole 31*b* is a hole for an engagement with a hook 33*d* of a cylindrical elastic body 33 that is described later.

A circuit board 20 side of the case 30 relative to the guide portion 31 has an insert pin 21 that serves as a joining pin. The number of the insert pins 21 is same as the number of the connection pins 15. In the present embodiment, two insert pins 21 are paired for correspondence with the connection pins 15. The insert pins 21 is insert molded in the case 30 to be integrated with the case 30. One end of the insert pin 21 is exposed in a space in the case 30, and the end extends to a position that corresponds to a position of the positioning hole 31*a* of the guide portion 31. At least the end of the insert pin 21 protruding from the case 30 is formed to be deformable by having a thin shape. The end of the insert pin 21 has a hole 21*a*, and a tip of the connection pin 15 is inserted in the hole 21*a*. The other end 21*b* of the insert pin 21 is exposed in the case 30 in a protruding manner in a direction in parallel with an insertion direction of the circuit board 20 in the case 30. The end 21*b* is inserted in a first through hole 20*a* that is formed on the circuit board 20.

An amount of protrusion of the insert pin 21 from the case 30 on the end that is connected with the connection pin 15 may be arbitrarily set as long as the end of the insert pin 21 can warp for absorbing a reaction force on the connection pin 15 when the reaction force is caused by a dislocation of the transducer due to a pressing force applied thereon for pressing the transducer into the case 30.

An upper side of the case 30 has an opening 32 in a round shape, and the transducer 10 having the cylindrical elastic body 33 pasted on the outer surface with the foaming elastic body 34 under the base 14 for suppressing vibration is inserted from the opening 32 to be assembled with the case 30. The opening 32 of the case 30 exposes the vibration surface 11*b* of the transducer 11, and the ultrasonic wave from the transducer 10 is emitted from the opening 32 toward an outside of the case 30.

An inner surface of the opening 32 of the case 30 has a third marker 38 for positioning a second marker 33*c* on the cylindrical elastic body 33. The third marker 38 is formed as a groove along the insertion direction of the transducer 10 into the case 30, and used for inserting the second marker 33*c* for positioning the transducer 10 in a circular direction.

Figure 3A:
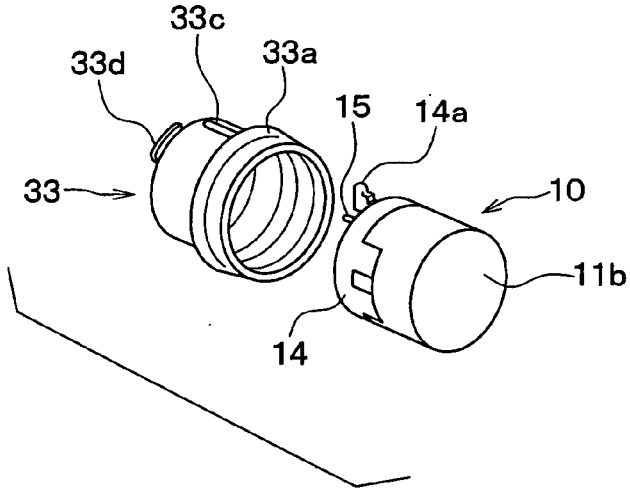
FIG. 3A shows a perspective exploded view of the ultrasonic transducer in the embodiment.
Figure 3B:
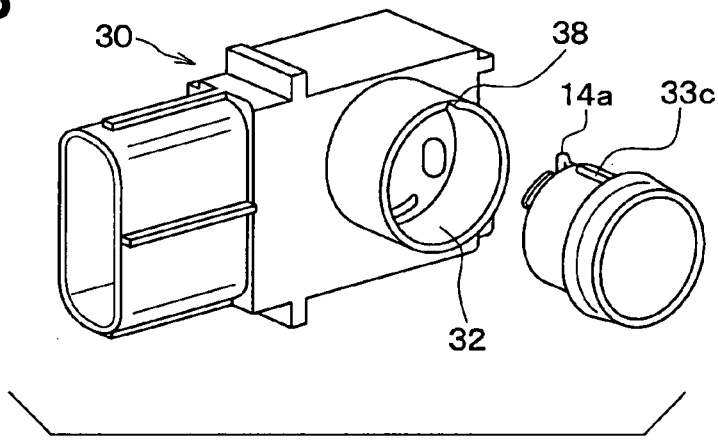
FIG. 3B shows another perspective exploded view of the ultrasonic transducer in the embodiment.
Figure 4A:
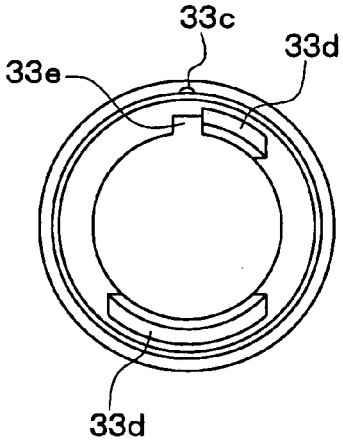
FIG. 4A shows a bottom view of a cylindrical elastic body in the embodiment.
Figure 4B:
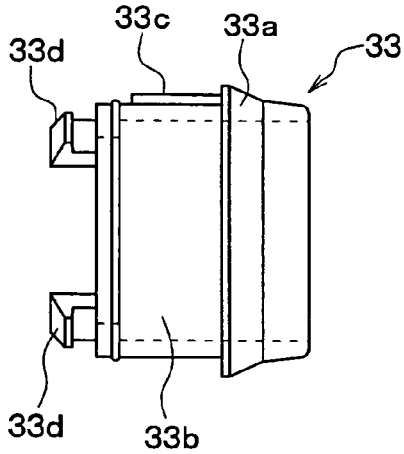
FIG. 4B shows a side view of the cylindrical elastic body in the embodiment.

FIGS. 3A and 3B show the exploded views in perspective. That is, FIG. 3A shows a perspective exploded view of the ultrasonic transducer 10 and the cylindrical elastic body 33, and FIG. 3B shows a perspective exploded view of the case 30 and the ultrasonic transducer 10 with the elastic body 33 attached thereon. FIGS. 4A and 4B show illustrations of the cylindrical elastic body 33. That is, FIG. 4A shows a bottom view (i.e., a case facing side) of the cylindrical elastic body 33, and FIG. 4B shows a side view of the cylindrical elastic body 33.

The cylindrical elastic body 33 is made of silicon rubber, and covers the outer surface of a cylinder portion 11*c* of the housing 11 in the transducer 10 for preventing transfer of unnecessary vibration from the transducer 10 to the case 30.

As shown in FIGS. 3A, 3B, 4A, and 4B, the cylindrical elastic body 33 has a flange 33*a* in a protruding shape on an opening 32 side of the case 30, an outer wall 33*b* for covering the outer surface of the transducer 33*c*, the hook 33*d* on an insertion end of the elastic body 33 into the opening 32 of the case 30, and a cut 33*e* on an inner surface of the outer wall 33*b* of the elastic body 33 for receiving the first marker 14*a*.

The flange 33*a* and the hook 33*d* binds a wall of the opening 32 at both ends of insertion direction of the transducer 10 when the transducer 10 is inserted into the opening 32. More practically, the hook 33*d* engages a reverse side (i.e., the circuit board side) of the guide portion 31 through a hole that is formed at a different position from the positioning hole 31*a* with a reaction force from the flange 33*a*.

The outer wall 33*b* has an inner diameter that has substantially the same value or slightly smaller value than that of the transducer 10. Therefore, the transducer 10 is covered by the outer wall 33*b* of the cylindrical elastic body 33 without a gap.

The second marker 33*c* is formed in parallel with the insertion direction of the transducer 10 into the opening 32 of the case 30. When the cylindrical elastic body 33 covers the transducer 10, the height of the second marker 33*c* is slightly smaller than the position of the tip end of the first marker 14*a* in a radial direction of the transducer 10.

The cut 33*e* is formed on the elastic body 33 for allowing the first marker 14*a* in a condition that the transducer 10 is covered by the elastic body 33.

When the transducer 10 is inserted in the cylindrical elastic body 33 with the first marker 14*a* aligned with the second marker 33*c*, the tip end of the first marker 14*a* is exposed from the outer wall 33*b* of the elastic body 33 with the first marker 14*a* and the second marker 33*c* aligned on the same line. Then, the tip end of the first marker 14*a* is guided by the third marker 38 for inserting the transducer 10 into the opening 32 of the case 30. In this manner, the protector portion 18 enters into the positioning hole 31*a* of the guide portion 31, and the connection pins 15 enters into the hole 21*a* of the insert pin 21. The transducer 10 is thereby fixed on the case 30 with the flange 33*a* and the hook 33*d*.

The foaming elastic body 34 is made of, for example, a foaming rubber, a silicon or the like. The foaming elastic body 34 has the connection pins 15 and the protector portion 18 disposed therein. The foaming elastic body 34 has a cut, and the cut receives the protector portion 18. Further, the transducer 10, the elastic body 33, and the foaming elastic body 34 are pasted with each other by silicon adhesive.

A portion of the case 30 separated by the guide portion 31 is filled with a damp-proof member 35. More practically, the circuit board 20 positioning side of the case 30 has a filling of the damp-proof member 35 for preventing dampness. The dampproof member 35 is, for example, a silicon resin or a urethane resin. The dampproof member 35 of the present embodiment is a silicon resin. In this case, as shown in FIGS. 2A and 2B, the circuit board 20 has external output terminals 36 for outputting signals, and one end of the output terminal 36 is exposed from a connector 37 that is formed on one face of the case 30.

The transducer 10 is assembled with the case 30 in the following manner. That is, the transducer 10 covered by the cylindrical elastic body 33 and the foaming elastic body 34 is inserted into the opening 32 of the case 30. The protector portion 18 is, with the connection pins 15, inserted into the positioning hole 31*a* of the guide portion 31 in the course of insertion of the transducer 10. Then, the hook 33*d* of the elastic body 33 enters into the through hole 31*b* of the guide portion 31 to be engaged with the reverse side of the guide portion 31.

In this manner, the transducer 10 is positioned at a predetermined position of the case 30, and the connection pins 15 are inserted into the hole 21*a* of the insert pins 21. Further, the transducer 10 with the elastic body 33 pasted thereon is fixed in the opening of the case 30. The insert pins 21 and the connection pins 15 are soldered for electrical coupling.

Further, the circuit board 20 is disposed in the case 30. In this manner, the end 21*b* of the insert pins 21 are inserted into the through holes 20*a* of the circuit board 20, and the external output terminals 36 are inserted into the through holes 20*b* (i.e., first through hole) of the circuit board 20. Then, the soldering of the terminals/pins with the holes enables electrical coupling of the piezoelectric element 12 with the circuit board 20 through the insert pins 31 as well as the electrical coupling of the external output terminals 36 with the circuit board 20.

After soldering the terminals and pins, the inner space of the case 30 are filled with the damp-proof member 35. In this case, the circuit board 20 is disposed in the case 30 after positioning the transducer 10. However, the circuit board 20 may be disposed in the case 30 before positioning the transducer 10 in the case 30.

The ultrasonic sensor 100 of the present disclosure has the connection pins 15 that protrude from a predetermined position of the base 14 and that are covered by the protector portion 18, thereby enabling an easy positioning of the ultrasonic transducer 10 relative to the positioning hole 31*a* of the case 30. In this manner, the connection pins 15 are protected from being damaged in the course of insertion into the holes 21*a* of the insert pins 21, together with the insertion of the end 21*b* of the insert pins 21 into the through holes 20*a* of the circuit board 20. As a result, the workability of assembling operation of the ultrasonic sensor 100 is improved.

The advantages of the present disclosure are derived from the connection structure of the connection pins 15 with the circuit board 20. That is, the connection pins 15 are connected to the circuit board 20 through the insert pins 21, instead of directly connected to the circuit board 20, thereby enabling a reaction force against excessive insertion of the transducer 10 into the case 30 to be released toward the insert pins 21. Further, ease of the positioning of the transducer 10 relative to the case 30 is improved by having the hole 21*a* to be aligned with the connection pins 15. Furthermore, the insert pins 21 and the external output terminals 36 are aligned with the holes 20*a*, 20*b*, thereby enabling the improvement of the workability of the assembling operation of the ultrasonic sensor 100.

Although the present invention has been fully described in connection with the preferred embodiment thereof with reference to the accompanying drawings, it is to be noted that various changes and modifications will become apparent to those skilled in the art.

For example, the insert pins 21 are insert molded with the case 30 in the above embodiment. However, the insert pins 21 may be formed in a different manner as long as they are integrated in the case 30. Further, the shape of the insert pins 21 may be different from the above embodiment. That is, the portion of the insert pin 21 exposed in the case 30 entirely formed as a thin portion in the above embodiment may be formed as a partially thinned portion for having the same effect of easy bending on an application of the excessive force.

Such changes and modifications are to be understood as being within the scope of the present invention as defined by the appended claims.

What is claimed is:

1. An ultrasonic sensor comprising:

an ultrasonic transducer in a housing with a bottom and a cylindrical body, wherein the bottom of the housing has a piezoelectric element disposed on an inside surface, wherein the piezoelectric element has a connection pin electrically coupled with the element with one end extending out of the housing, and wherein the connection pin pierces a base that is disposed on the housing;

a cylindrical elastic member that covers an outer peripheral surface and a connection pin pull-out surface of the transducer;

a hollow case having an opening through which the transducer is inserted therein, wherein the case holds the transducer with the elastic member disposed thereon in the opening;

a joining pin disposed in an exposing manner in a hollow space in the case, wherein an exposed portion of the joining pin is electrically coupled with the connection pin in the hollow space in the case, and wherein the joining pin warps in an insertion direction when the connection pin is pressed in the insertion direction of the transducer into the opening; and a circuit board disposed in the hollow space of the case in an electrically coupled condition with the piezoelectric element, wherein the electrically coupled condition of the circuit board with the piezoelectric element is achieved by an electrical coupling of the circuit board with the joining pin and the connection pin.

2. The ultrasonic sensor as in claim 1, wherein the joining pin is an insert pin that is formed by an insert molding in the case, and the insert pin has one end that is exposed in the hollow space in the case.

3. The ultrasonic sensor as in claim 2, wherein the insert pin has a hole on one end, and the connection pin and the hole on the insert pin are configured to have a positional relationship that the one end of the connection pin extending out of the housing enters into the hole when the transducer is disposed on the case.

4. The ultrasonic sensor as in claim 3 further comprising:

a guide portion for separating the opening for having the transducer and the hollow space for having the circuit board, wherein the guide portion has a positioning hole formed therein, and wherein the positioning hole has the connection pin inserted therein, wherein the one end of the connection pin is configured to enter into the hole of the insert pin when the one end of the connection pin extending out of the housing is inserted in the positioning hole.

5. The ultrasonic sensor as in claim 3 further comprising:

a first marker disposed on the transducer, wherein the first marker radially protrudes out of the outer peripheral surface of transducer;

a second marker formed on the outer peripheral surface of the cylindrical elastic member; and a third marker formed on an inside wall of the opening of the case, wherein the first marker of the transducer and the second marker on the elastic member are aligned with each other for covering the transducer with the elastic member, and the first marker and the second marker are aligned with the third marker for inserting the transducer in the opening.

6. The ultrasonic sensor as in claim 2, wherein an other end of the insert pin extends in an insertion direction of the circuit board into the hollow space of the case, and the other end of the insert pin and a first through hole on the circuit board are configured to have a positional relationship that the other end of the insert pin is inserted in the first though hole when the circuit board is inserted in the hollow space of the case.

7. The ultrasonic sensor as in claim 6 further comprising:

an external connection terminal in the case for electrically coupling with the circuit board with an insertion into a second through hole of the circuit board, wherein one end of the terminal to be coupled with the circuit board extends in the insertion direction of the circuit board into the hollow space of the case, and the one end of the terminal and the second through hole of the circuit board are configured to have a positional relationship that the one end of the terminal is inserted in the second through hole when the circuit board is inserted in the hollow space of the case.

* * * * *